US005311940A

United States Patent [19]

LaFleur

[11] Patent Number: 5,311,940

[45] Date of Patent: May 17, 1994

[54] CEMENTING PLUG

[75] Inventor: Karl K. LaFleur, Weatherford, Tex.

[73] Assignee: LaFleur Petroleum Services, Inc., Weatherford, Tex.

[21] Appl. No.: 38,174

[22] Filed: Mar. 29, 1993

Related U.S. Application Data

[62] Division of Ser. No. 777,645, Oct. 16, 1991, Pat. No. 5,242,018.

[51] Int. Cl.[5] ..... E21B 33/00

[52] U.S. Cl. ..... 166/152; 166/192

[58] Field of Search ..... 166/153-155, 166/192, 193, 285, 291, 386

[56] References Cited

U.S. PATENT DOCUMENTS

| | | |
|---|---|---|
| 1,392,105 | 9/1921 | Bergesen, Sr. . |
| 1,598,771 | 9/1926 | Gerhardt . |
| 1,713,895 | 5/1929 | Ford . |
| 2,392,144 | 1/1946 | Hall . |
| 2,447,966 | 8/1948 | Stephens . |
| 2,567,475 | 9/1951 | Hall . |
| 3,541,628 | 11/1970 | Girard . |
| 3,616,850 | 11/1971 | Scott . |
| 3,635,288 | 1/1972 | Lebourg . |
| 3,842,905 | 11/1974 | Morrisett et al. . |
| 4,164,980 | 8/1979 | Duke . |
| 4,175,619 | 11/1979 | Davis . |
| 4,190,111 | 2/1980 | Davis . |
| 4,190,112 | 2/1980 | Davis . |
| 4,345,350 | 8/1982 | Burd . |
| 4,378,838 | 4/1983 | Ogden et al. . |
| 4,427,065 | 1/1984 | Watson . |
| 4,548,271 | 10/1985 | Keller . |
| 4,711,300 | 12/1987 | Wardlaw, III et al. . |
| 4,836,279 | 6/1989 | Freeman . |
| 4,858,687 | 8/1989 | Watson et al. . |
| 4,896,720 | 1/1990 | DeRouen . |

FOREIGN PATENT DOCUMENTS

| | | |
|---|---|---|
| 0225145 | 6/1987 | European Pat. Off. . |
| 727621 | 4/1955 | United Kingdom . |

*Primary Examiner*—Thuy M. Bui

*Attorney, Agent, or Firm*—Randall C. Brown

[57] ABSTRACT

Cementing plugs for use in the cementing of casing in oil and gas wells. The cementing plugs are well-suited for use with a polycrystalline diamond compact drill bit.

2 Claims, 3 Drawing Sheets

CEMENTING PLUG

This is a divisional of copending application Ser. No. 07/777,645 filed on Oct. 16, 1991, now U.S. Pat. No. 5,242,018.

BACKGROUND OF THE INVENTION

1. Field of the Invention

The present invention relates to cementing plugs for use in the cementing of casing in oil and gas wells. More specifically, the present invention relates to cementing plugs that are particularly well suited for use with a polycrystalline diamond compact (PDC) drill bit. The cementing plugs of the present invention may be configured as bottom cementing plugs or top cementing plugs.

2. Description of the Prior Art

It is well known in the art to conduct oil and gas well cementing procedures with a cementing plug container assembly that is designed to contain one or more cementing plugs for injection into the casing of a well. Typically, a first cementing plug is injected prior to the introduction of cement into the casing and a second cementing plug is injected to displace the cement through the casing and to cement the casing in the well. Conventional cementing plugs are made of an aluminum or plastic core and a finned outer shell made of rubber.

Typically, drilling operations are resumed after the casing is cemented in the well. When drilling operations are resumed, the drill bit must first pass through the cementing plugs which are lodged at the lower end of the cemented casing. Conventionally, the cementing plugs and any residual cement are drilled out and removed from the casing with tooth-type rock bits. The teeth on a conventional rock bit are effective in drilling through the conventional cementing plugs made of aluminum and rubber even though the plugs are free to rotate within the casing.

A polycrystalline diamond compact (PDC) drill bit has been introduced to the drilling bit art that advantageously replaces tooth-type rock bits under certain conditions. PDC drill bits, however, do not drill through conventional cementing plugs made of aluminum and rubber as effectively as conventional tooth-type rock bits. Instead, PDC drill bits tend to spin the cementing plugs within the casing. To overcome this problem it has been proposed to use a non-rotating plug set as disclosed in U.S. Pat. Nos. 4,836,279 and 4,858,687. These attempts, however, to overcome the incompatibility, from a drilling standpoint, of PDC drill bits and cementing plugs have been largely unsuccessful.

SUMMARY OF THE INVENTION

The cementing plugs of the present invention overcome the above-mentioned drawbacks and disadvantages which are characteristic of the prior art.

The cementing plugs of the present invention comprise a cylindrical body having a bore extending therethrough, a coating covering a portion of the cylindrical body and a removable septum disposed within the bore of the cylindrical body.

The cylindrical body preferably includes concentrically arranged first and second portions wherein the second portion is disposed about the first portion.

The bore of the cylindrical body preferably is cylindrical and is divided into an upper bore portion and a lower bore portion. The diameter of the upper bore portion is larger than the diameter of the lower bore portion. A shoulder is defined within the bore of the cylindrical body at the transition point between the upper bore portion and the lower bore portion. The septum disposed within the bore of the cylindrical body rests upon the shoulder.

When it is desired to configure a cementing plug of the present invention as a bottom plug, a removable septum that will rupture at a selected hydraulic pressure that will be developed within the casing being cemented is disposed within the bore of the cylindrical body. When it is desired to configure a cementing plug of the present invention as a top plug, a removable septum that will not rupture at any hydraulic pressure that will be developed within the casing being cemented is disposed within the bore of the cylindrical body.

In still another embodiment of the present invention, a bottom cementing plug further includes a nose portion that is adapted to be received by a receptacle retained within the casing being cemented. According to this embodiment, a top cementing plug further includes a similar nose portion that is adapted to be received by the upper bore portion of the cylindrical body of the bottom plug.

In still another embodiment of the present invention, the cementing plug comprises a cylindrical body, a removable nose and a coating covering the cylindrical body. The cylindrical body preferably includes concentrically arranged first and second portions wherein the second portion is disposed about the first portion. The removable nose preferably is threadedly engaged with the first portion of the cylindrical body.

In a still further embodiment of the present invention, a locking collar is retained within the casing being cemented and comprises a multiplicity of inwardly protruding bristles. The bristles preferably prevent rotation of a cementing plug with respect to the casing.

Numerous objects, features and advantages of the present invention will be readily apparent to those skilled in the art upon a reading of the following disclosure when taken in conjunction with the accompanying drawings.

DESCRIPTION OF THE PREFERRED EMBODIMENTS

Figure 1:
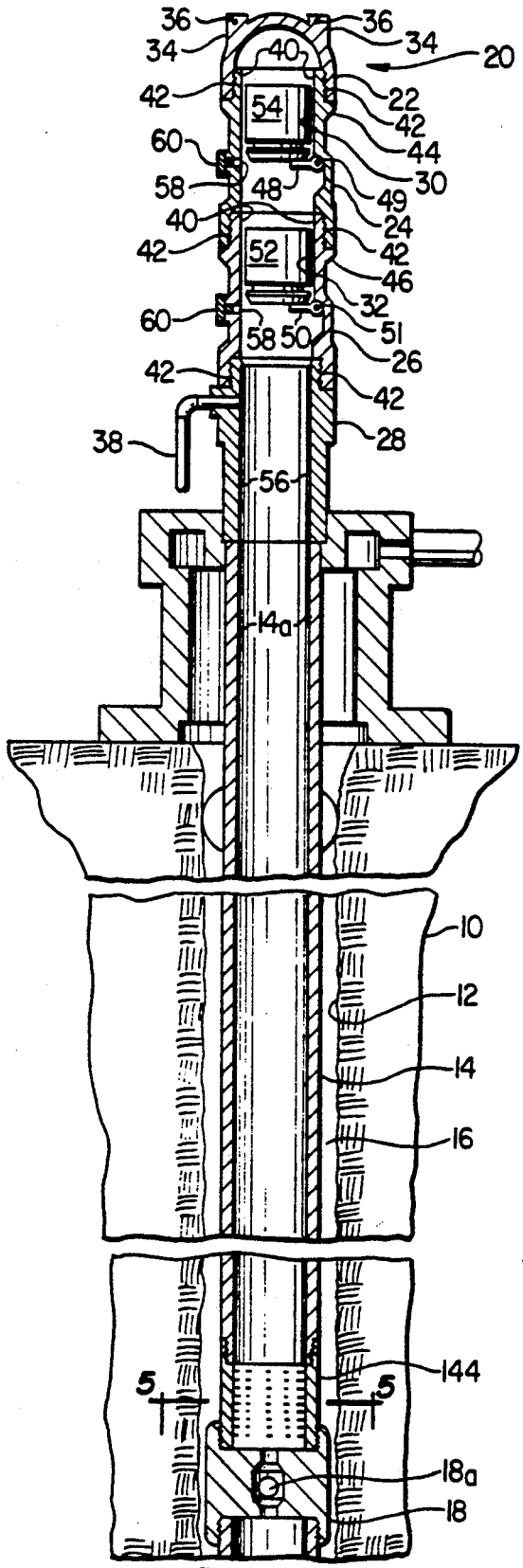
FIG. 1 is a vertical section view in somewhat schematic form of a well which is in readiness for cementing of the main well casing in accordance with the present invention.
Figure 5:
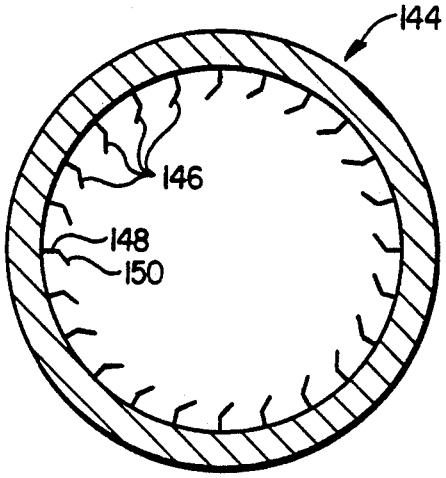
FIG. 5 is a section taken along line 5—5 of FIG. 1.

In the description which follows, like parts are marked throughout the specification and drawings with the same reference numerals, respectively. The drawing figures are not drawn to scale and certain features may be shown exaggerated in scale or in somewhat schematic form in the interest of clarity and conciseness.

Referring now to the drawings, and particularly to FIG. 1, there is illustrated a wellbore 12 which has been drilled into an earth formation 10. A casing 14 is set in place within the wellbore 12 and is connected to a cementing head 20. An annular space 16 between the casing 14 and the wellbore 12 has been prepared to be filled with a conventional hardenable cement composition. The annular space 16 is to be filled with the cement composition by injecting the cement composition through the casing 14 by way of the cementing head 20.

The casing 14 typically includes a check valve member 18 which shall be referred to herein as float collar 18. The float collar 18 prevents circulation of wellbore fluids up through the interior of the casing 14 from the bottom thereof. The float collar 18 includes a passage 18*a* that allows circulation of fluids from the casing 14 into the annular space 16.

The cementing head 20 includes a dome 22, an upper housing 24, a lower housing 26, and a saver sub 28. Upper housing 24 and lower housing 26 together define a plug chamber bore 40. In addition, upper housing 24 defines a top plug chamber 30 and lower housing 26 defines a bottom plug chamber 32. Top plug chamber 30 and bottom plug chamber 32 accommodate a top cementing plug 54 and a bottom cementing plug 52, respectively, as hereinafter described.

Dome 22 is provided with a pair of flanges 34, fitted with apertures 36 for lifting purposes. Saver sub 28 includes a conduit 38 for introducing fluid, such as a hardenable cement composition, into the saver sub 28. The saver sub 28 is designed to attach to substantially any well pipe in an existing oil or gas well, such as casing 14.

Dome 22 is threadedly attached to upper housing 24 by threads 42, and rests on the shoulder 44 of upper housing 24. Similarly, upper housing 24 is attached to lower housing 26 by threads 42, and rests on shoulder 46 of lower housing 26. Lower housing 26 is in turn connected to saver sub 28 by threads 42.

Inlet aperture caps 60 are shown as being inserted in inlet apertures 58 in upper housing 24 and lower housing 26. Either or both of the inlet apertures 58 may be opened by removing the respective inlet aperture cap 60.

When it is desired to cement the casing 14 within the wellbore 12, the bottom plug 52 is launched from the cementing head 20 into the bore 56 of saver sub 28. The diameter of the bottom plug 52 generally is greater than the diameter of the bore 56 of the saver sub 28 and the diameter of the bore 14*a* of the casing 14. The bottom plug 52 therefore does not pass through the saver sub 28 and the casing 14 under the influence of gravity alone. A cement composition is injected into saver sub 28 by way of conduit 38 after the launching of the bottom plug 52. The cement composition forces the bottom plug 52 through the bore 56 of saver sub 28 and the bore 14*a* of the casing 14. The bottom plug 52 forms a spacer between the drilling fluid within the casing 14 and the cement composition which follows bottom plug 52. Since the diameter of the bottom plug 52 is greater than the diameter of the bore 14*a* of the casing 14, the bottom plug 52 cleans the interior walls of the casing 14 as it is pumped downwardly by the following column of cement until it engages the float collar 18.

After the bottom plug 52 has been pumped down to the float collar 18, a frangible septum (shown and described later) associated with the bottom plug 52 is ruptured under fluid pressure to open a passage through the plug 52. The cement composition or other fluid then flows through the passage through the plug 52 and the passage 18*a* of float collar 18 into the annular space 16 between the wellbore 12 and the casing 14.

When it is desired to displace the casing 14 of residual cement, the top plug 54 is launched from the cementing head 20 into the bore 56 of saver sub 28. The diameter of the top plug 54 generally has the same relationship as the bottom plug 52 to the diameter of the bore 56 of the saver sub 28 and the bore 14*a* of the casing 14. A displacing fluid is then introduced into conduit 38 to force the top plug 54 through the bore 56 of the saver sub 28 and the bore 14*a* of the casing 14. Sufficient displacing fluid is introduced to ensure that the top plug 54 engages the bottom plug 52.

The bottom plug 52 and the top plug 54 are launched from the cementing head 20 in a conventional manner such as that disclosed in U.S. Pat. No. 4,427,065 to Watson, the disclosure of which is hereby incorporated by reference.

While a particular cementing head has been described herein for illustrating the environment in which the cementing plugs of the present invention have utility, those of ordinary skill in the art will recognize that any conventional cementing head that is capable of launching one or more cementing plugs into the casing of a well may be used to launch the cementing plugs of the present invention.

Figure 2:
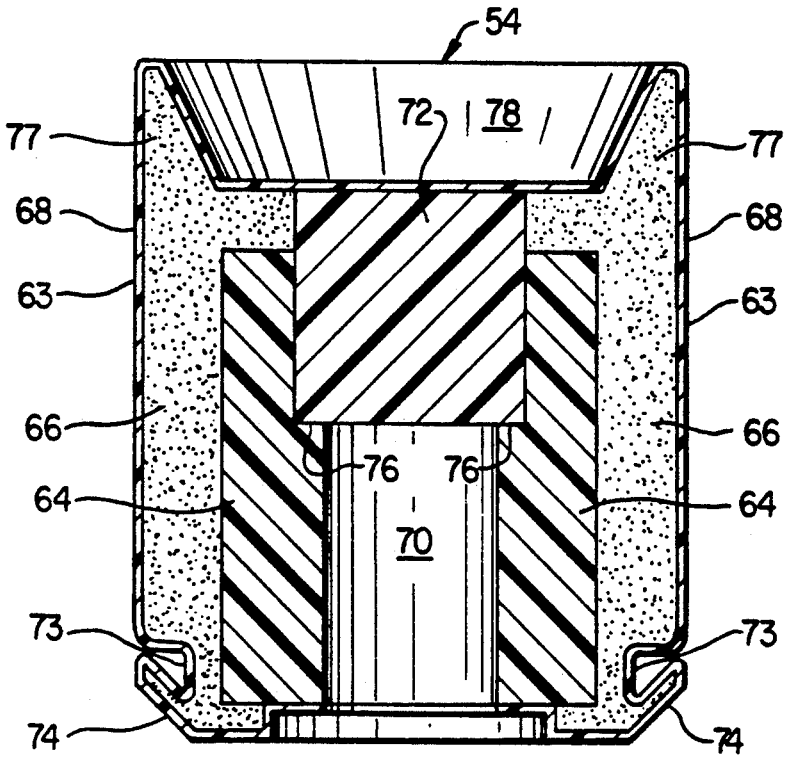
FIG. 2 is a cross-sectional view of a cementing plug of the present invention.
Figure 3:
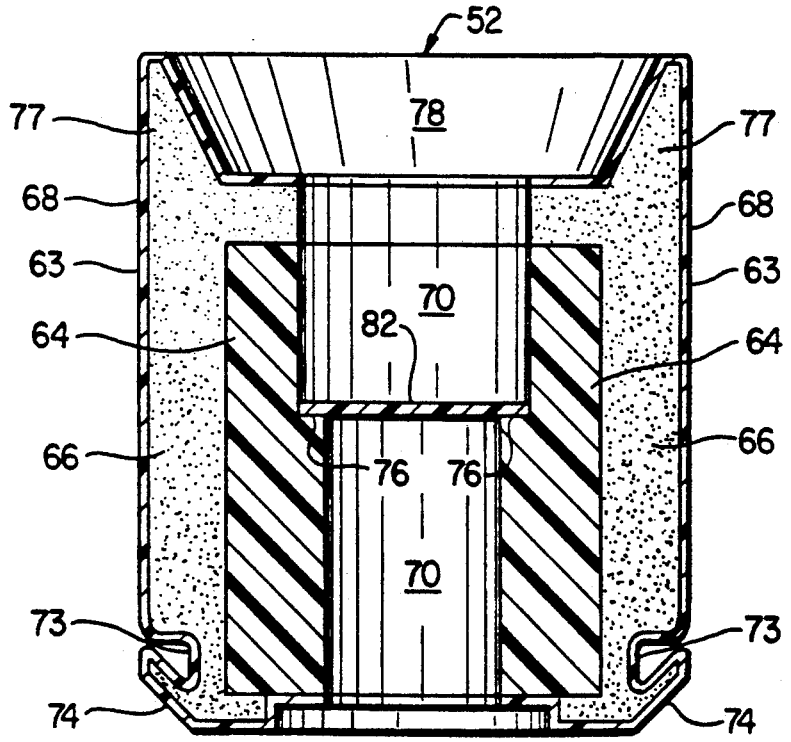
FIG. 3 is a cross-sectional view of a cementing plug of the present invention.

As shown in FIGS. 2 and 3, the cementing plug of the present invention may be configured as a top cementing plug 54 or a bottom cementing plug 52. The cementing plugs 54 and 52 include a cylindrical body 63 comprised of a first cylindrical core member 64 and a second cylindrical core member 66, a coating 68 covering a portion of the cylindrical body 63 and a removable septum 72 or 82. The second cylindrical core member 66 is concentrically disposed about the first cylindrical core member 64. The first and second cylindrical core members 64 and 66 define a bore 70 extending lengthwise through the cementing plugs 54 and 52. A shoulder 76 is formed on the first cylindrical core member 64 and protrudes radially inward with respect to the bore 70.

The coating 68 assists in cleaning drilling fluid, filter cake or other debris from the interior walls of the casing 14 as the cementing plugs 54 and 52 are pumped down the casing 14.

A groove 73 and a wiper 74 are formed on the lower portion of the second cylindrical core member 66. The wiper 74 facilitates the entry of the cementing plugs 54 and 52 into the bore 56 of the saver sub 28 and the bore 14*a* of the casing 14. The groove 73 allows greater flexibility of the wiper 74 as the cementing plugs 54 and 52 are pumped down the casing 14.

The second cylindrical core member 66 of the cementing plugs 54 and 52 further includes a flange 77 and defines a frusto-conical depression 78. The flange 77 and frusto-conical depression 78 of one plug sealingly receive the wiper 74 and groove 73 of a corresponding plug. In addition, when disposed within the casing 14, the flange 77 seals against the inner wall of the casing 14 under the influence of hydraulic pressure and further enhances the seal of the cementing plugs 54 and 52 within the casing 14.

As shown in FIGS. 2 and 3, respectively, the removable septums 72 or 82 are disposed within bore 70 and rest upon shoulder 76. The removable septum 72 of the top plug 54 is selected to be infrangible under the hydraulic pressure developed within a particular well by the displacing fluid that follows the top plug 54. The removable septum 82 of the bottom plug 52 is selected to be frangible under the hydraulic pressure developed within a particular well by the column of cement that follows the bottom plug 52. Thus, the selection of the removable septums 72 and 82 depends upon the characteristics of the well being cemented and those of ordinary skill in the art will recognize how to select an appropriate septum that will be frangible or infrangible, as desired.

Those of ordinary skill in the art will recognize that a cementing plug of the present invention may be configured as a top cementing plug 54 or a bottom cementing plug 52 by inserting either an infrangible septum 72 or a frangible septum 82 within the bore 70 of the cementing plugs 54 or 52. Thus, according to this embodiment of the present invention, only one cementing plug type is required at a well site along with a supply of infrangible septums 72 and frangible septums 82.

The outer diameter of the cementing plugs 54 and 52 is greater than the diameter of the bore 14*a* of the casing 14 so that the cementing plugs 54 and 52 wipe and seal against the interior walls of the casing 14 as the plugs are pumped down the casing 14. The outer diameter of the cementing plugs 54 and 52 preferably is approximately 3% greater than the inside diameter of the casing 14. The cementing plugs 54 and 52 comprise materials that allow them to elongate and contract with no loss in performance in response to varying pressure exerted on the plugs by the casing 14 as the plugs are pumped downhole.

Figure 4:
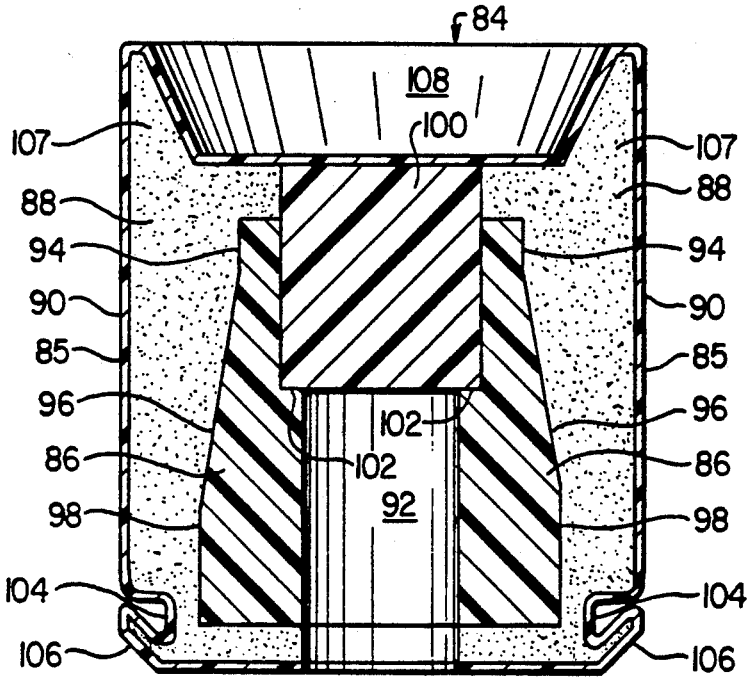
FIG. 4 is a cross-sectional view of a cementing plug of the present invention.

An alternate embodiment of a cementing plug of the present invention is shown in FIG. 4. According to this embodiment, a cementing plug 84 includes a cylindrical body 85 comprised of a first cylindrical core member 86 and a second cylindrical core member 88, a coating 90 covering a portion of the cylindrical body 85 and a removable septum 100. The second cylindrical core member 88 is concentrically disposed about the first cylindrical core member 86. The first and second cylindrical core members 86 and 88 define a bore 92 extending lengthwise through the cementing plug 84. A shoulder 102 is formed on the first cylindrical core member 86 and protrudes radially inward with respect to the bore 92. The cementing plug depicted in FIG. 4 is configured as a top plug with an infrangible removable septum 100 disposed within the bore 92 and supported by should 102 formed on the first cylindrical core member 86. Those of ordinary skill in the art will recognize that a frangible septum may replace the infrangible septum 100 to configure the cementing plug 84 as a bottom plug.

As shown in FIG. 4, the first cylindrical core member 86 comprises an upper portion 94, a middle portion 96 and a lower portion 98. The outer diameter of the lower portion 98 is greater than the outer diameter of the upper portion 94. The outer diameter of the middle portion continuously decreases from the lower portion 98 to the upper portion 94. The cementing plug 84 which includes a first cylindrical core member 86 with the above-described upper portion 94, middle portion 96 and lower portion 98 advantageously seals against the casing 14 under the influence of hydraulic pressure.

A groove 104 and wiper 106 are formed on the lower portion of the second cylindrical core member 86. The groove 104 and wiper 106 correspond to and have the respective function as the groove 73 and wiper 74 of the cementing plugs depicted in FIGS. 2 and 3.

The second cylindrical core member 88 of the cementing plug 84 further includes a flange 107 and defines a frusto-conical depression 108. The flange 107 and frusto-conical depression 108 of one plug sealingly receive the wiper 106 and groove 104 of a corresponding plug.

Figure 7:
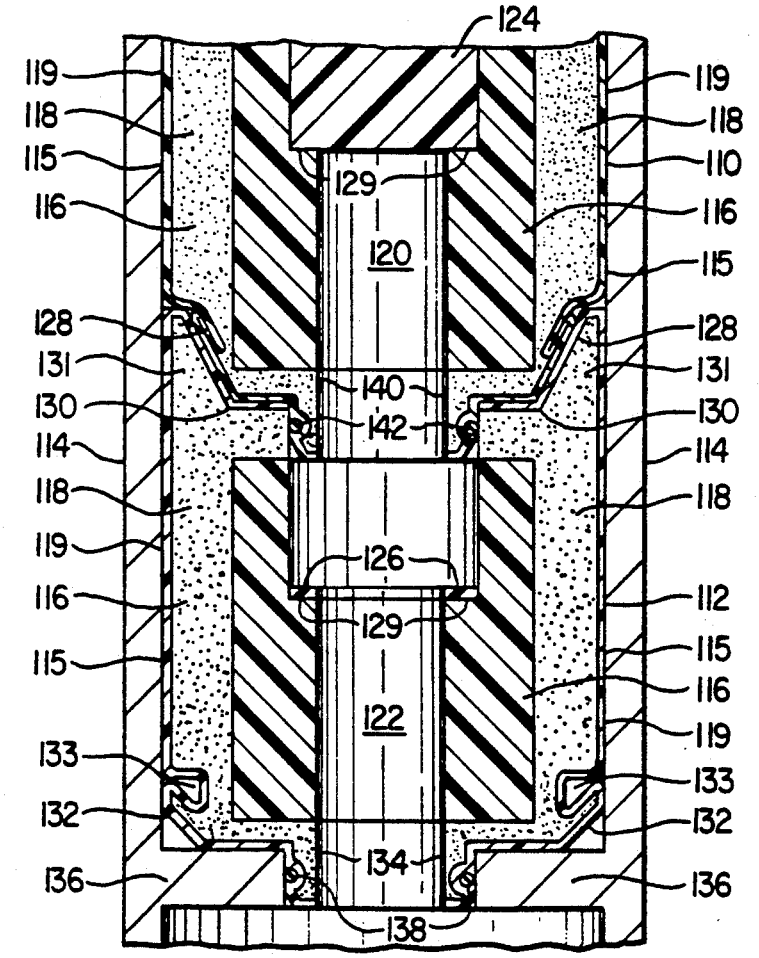
FIG. 7 is a cross-sectional view of a cementing plug set of the present invention.

Another alternative embodiment of the cementing plugs of the present invention is shown in FIG. 7. According to this embodiment, a top plug 110 and a bottom plug 112 each include a cylindrical body 115 comprised of a first cylindrical core member 116 and a second cylindrical core member 118, and a coating 119 covering a portion of the cylindrical body 115 of the top plug 110 and the bottom plug 112. The top plug 110 further includes a removable infrangible septum 124 while the bottom plug 112 includes the remains 126 of a removable frangible septum.

The first and second cylindrical core members 116 and 118 define a top plug bore 120 and a bottom plug bore 122 extending lengthwise through the top plug 110 and bottom plug 112, respectively.

The second cylindrical core member 118 of the bottom plug further includes a flange 131 and defines a frusto-conical depression 130. The second cylindrical core member 118 of the top plug further includes a flange (not shown) and defines a top plug frusto-conical depression (not shown).

A shoulder 129 is formed on the first cylindrical core member 116 of top plug 110 and bottom plug 112. Each shoulder 129 protrudes radially inward with respect to the bores 120 and 122. A top plug removable infrangible septum 124 is supported by shoulder 129 formed on the first cylindrical core member 116 of top plug 110 while the remains 126 of a removable frangible septum are supported by shoulder 129 formed on the first cylindrical core member 116 of bottom plug 112.

The bottom plug 112 includes a groove 133 and a wiper 132 formed on the lower portion of the second cylindrical core member 118. An annular nose 134 extending below the wiper 132 is also formed on the lower portion of the second cylindrical core member 118. The annular nose 134 includes a groove for receiving a pressure-activated sealing member 138.

The top plug 110 includes a wiper 128 formed on the lower portion of the second cylindrical core member 118. An annular nose 140 extending below the top plug wiper 128 is also formed on the lower portion of the second cylindrical core member 118. The annular nose 140 includes a groove for receiving a pressure activated sealing member 142.

As shown in FIG. 7, bottom plug 112 and top plug 110 are disposed within a casing 114. According to this embodiment of the present invention, the casing 114 includes a casing receptacle 136 and the nose 134 of bottom plug 112 sealingly engages the casing receptacle 136. In addition, the nose 140 of the top plug 110 sealingly engages the bottom plug bore 122, while the frusto-conical depression 130 of bottom plug 112 sealingly receives the wiper 128 and groove (not shown) of the top plug 110. The embodiment of the invention depicted in FIG. 7 is particularly well adapted for cementing procedures involving conditions of extremely high hydraulic pressure.

Figure 6:
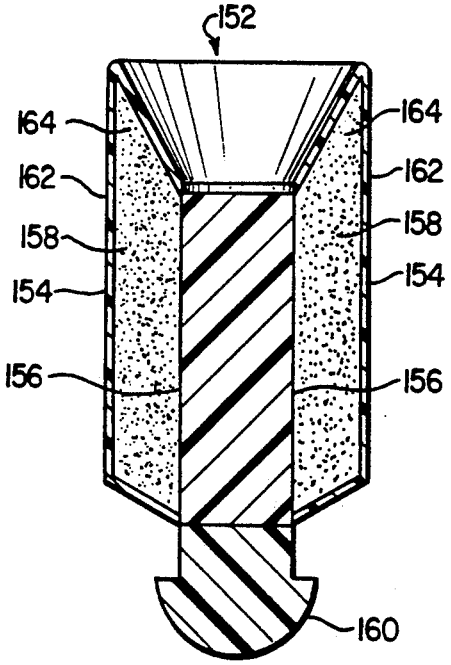
FIG. 6 is a cross-sectional view of a cementing plug of the present invention.

Still another alternate embodiment of a cementing plug of the present invention is depicted in FIG. 6. According to this embodiment, the cementing plug is configured as a flex plug 152. The flex plug 152 comprises a cylindrical body 154, a first cylindrical body portion 156 and a second cylindrical body portion 158 disposed about the first cylindrical body portion 156. A nose 160 is engaged with the first cylindrical body portion 156. An outer coating 162 surrounds the second cylindrical body portion 158.

The nose 160 preferably is threadedly engaged with the first cylindrical body portion 156. The nose 160 is shown in FIG. 6 as having a specific profile, however, those of ordinary skill in the art will recognize that the nose 160 may have any desired profile.

The second cylindrical body portion 158 includes a flange 164. When disposed within a casing, the flange 164 seals against the inner wall of the casing under the influence of hydraulic pressure.

The flex plug 152 depicted in FIG. 6 is particularly well adapted for use in stage cementing operations in which the diameter of the cementing plug or flex plug must be able to adapt from a large diameter to a small diameter and rebound to the original large diameter.

In all of the foregoing embodiments, it is preferred that all components of the plugs are formed of any suitable material that is easily drillable by polycrystalline diamond compact drill bits. The term "polycrystalline diamond compact drillable material" is defined to mean such suitable materials and expressly excludes from its definition rubber, aluminum and other metals. In preferred embodiments of the plugs of the present invention, the first cylindrical core members 64, 86 and 116; the septums 72, 82, 100, 124 and 126; and the first cylindrical body portion 158, and nose 160 comprise a polycrystalline diamond compact drillable plastic material. The polycrystalline diamond compact drillable plastic material preferably comprises a thermosetting plastic material and most preferably comprises phenolic resin which is the heat-cured thermoset reaction product of phenol and formaldehyde.

Alternatively, the polycrystalline diamond compact drillable plastic material preferably comprises an instant set polymer such as a mixture of a resin and an isocyanate. A particularly preferred instant set polymer is a mixture of a polymethylene resin and a polyphenylisocyanate and is commercially available from Dow Chemical Company of Midland, Mich. under the trade name ISP 270.

In other preferred embodiments of the plugs of the present invention, the second cylindrical core members 66, 88 and 118, and the second cylindrical body portion 158 comprise a polycrystalline diamond compact drillable solid, resilient foam material. The solid resilient foam material preferably has good memory properties. The solid, resilient foam material preferably comprises a non-rigid polyurethane foam, most preferably having a density of from 8 to 10 pounds per cubic foot.

The coatings 68, 90, 119 and 162 comprise a polycrystalline diamond compact drillable solid elastomeric material. The polycrystalline diamond compact drillable solid elastomeric material preferably comprises a thin polyurethane plastic coating or a self-skinning foam having a hardness of 60 to 70 durometer and a thickness of about 0.075 inches.

In a preferred embodiment of the present invention, a locking collar 144 is incorporated in the casing 14 immediately uphole of the float collar 18. The locking collar 144 includes a multiplicity of inwardly protruding and radially spaced bristles 146. The bristles are preferably spaced apart equally one from the other around the circumference of the locking collar 144. The bristles 146 include an inwardly projecting portion 148 and an angled portion 150. The angled portion 150 of each bristle 146 is disposed to penetrate the outer coating and second cylindrical core member of a cementing plug of the present invention and prevent the rotation of the plug as the plug is being drilled out of the casing.

In operation, and referring again to FIG. 1 of the drawings, a cementing head 20 can be used to inject a pair of cementing plugs 52, 54 into the well casing 14 as follows. A saver sub 28 is initially threaded and prepared to connect to an existing oil or gas well casing 14 according to procedures known to those skilled in the art. After the cementing head 20 has been connected to the casing 14, dome 22 is removed from upper housing 24 and the bottom plug 52 is inserted in bottom plug chamber 32 of lower housing 26. Subsequently, the top plug 54 is inserted in top plug chamber 30 of upper housing 24.

The plug 52 is preferably retained in the cementing head 20 just below the plug 54 by a suitable mechanism such as a plug release arm 50. In like manner, the top plug 54 is preferably retained in the position illustrated in FIG. 1 by a plug release arm 48. Those of ordinary skill in the art will recognize that any conventional plug release means may be utilized such as those disclosed in U.S. Pat. No. 4,427,065 to Watson, the disclosure of which is incorporated herein by reference.

Dome 22 is then threadedly engaged with upper housing 24 and is secured tightly against upper housing shoulder 44.

When it is desired to begin pumping cement through cementing head 20 and into the well casing 14, the conduit 38 is placed in communication with a source of flowable cement slurry (not shown) and the bottom plug release (not shown) is activated causing the plug release arm 48 to rotate in a counter-clockwise direction whereby the bottom plug 52 is launched into the mouth of the saver sub 28.

After the plug 52 has been launched by releasing the plug release arm 48, the cement slurry is pumped into the cementing head 20 so that the hydraulic pressure of the cement slurry forces the plug 52 through the bore 56 of the saver sub 28 and the plug 52 precedes a column of cement into the casing 14. When the plug 52 has engaged the float collar 18, the hydraulic pressure of the cement slurry in the casing 14 is increased until the frangible septum of the plug 52 ruptures to open the bore 70 of the plug 52 whereby cement is allowed to pass through the passage **18*a* of the float collar 18 and into the annular space 16 between the wellbore 12 and the casing 14**.

When it is desired to displace residual cement from the casing, the top plug release (not shown) is activated causing the upper plug release arm 50 to rotate in a counter-clockwise direction whereby the top plug 54 is launched into the mouth of the saver sub 28.

A source of displacement fluid, not shown, is then placed in communication with the conduit 38. The displacement fluid is injected in the casing 14 to pump the plug 54 through the bore 56 of the saver sub bore 28 and the bore **14*a* of the casing 14 to displace the cement composition from the casing 14**.

After a suitable waiting period for the cement to set that is disposed in the annular space 16 between the well bore 12 and the casing 14, a drill bit is then lowered through the casing to drill out the plugs 52 and 54, as well as the float collar 18.

While the plugs 52 and 54 are pumped down the casing 14, the coating 68 of the plugs 52 and 54 thoroughly wipes, scrapes and cleans the interior surface of the casing 14 of substantially any accumulation of debris, cement material, drilling fluid, pipe composition and so forth. Accordingly, substantially all of the debris and unwanted material which has accumulated on the inside walls of the casing 14, generally above the float collar 18, is cleaned in one continuous operation. Those skilled in the art will recognize that the plugs 52 and 54 may, however, be traversed through the casing 14 at other times for the purpose of cleaning the inside walls of the casing 14.

While the operation of the cementing plugs of the present invention has been described generically with respect to cementing plugs 52 and 54, those of ordinary skill in the art will recognize that cementing plugs 84, 110 and 112 with appropriate septums may be utilized as desired.

As noted above, the cementing plugs 110 and 112 are particularly suitable for maintaining the seal between the plug 110, the plug 112 and the casing 14 under conditions of high hydraulic pressure.

The cementing plug 84 provides a particularly advantageous seal between the plug 84 and the casing 14. Under the influence of hydraulic pressure, the second cylindrical core member 88 of the plug 84 separates from the first cylindrical core member 86 and is compressed to enhance the seal between the plug 84 and the casing 14. An increase in hydraulic pressure causes the second cylindrical core member 88 to further enhance the seal between the plug 84 and the casing 14.

As noted above, the flex plug 152 may be advantageously used in connection with a stage cementing job. The flex plug 152 traverses casing of widely different diameter while maintaining a seal between the plug 152 and the casing by virtue of the second cylindrical body portion 158 which expands and contracts in response to the varying inside diameter of the casing. When the nose 160 lands in a receiving device located in the casing, the second cylindrical body portion 158 separates from the first cylindrical body portion 156 under the influence of hydraulic pressure to enhance the seal between the plug 152 and the casing.

Although preferred embodiments of the cementing plugs in accordance with the present invention have been described herein, those skilled in the art will recognize that various substitutions and modifications may be made to the invention without departing from the scope and spirit thereof as recited in the appended claims.

What is claimed is:

1. A cementing plug comprising:

a) a first body portion comprising solid polycrystalline diamond compact drillable material;

b) a second body portion concentrically disposed about said first body portion and comprising polycrystalline diamond compact drillable material, said second body portion having a frustoconical first end, a cylindrical intermediate portion and a second end defining a flange, wherein said second body portion has a constant outside diameter except at said frustoconical first end thereof where said outside diameter tapers from said constant diameter to the outer surface of said first body portion; and c) a nose comprising polycrystalline diamond compact drillable material engaged with said first body portion adjacent said first end of said second body portion.

2. A cementing plug according to claim 1, wherein said nose is threadedly engaged with said first body portion.

* * * * *